United States Patent [19]

Muller et al.

[11] Patent Number: 4,801,305

[45] Date of Patent: Jan. 31, 1989

[54] MOTOR-FUELS

[75] Inventors: Heinrich Muller, Wesseling; Karl-Heinz Keim, Heimerzheim, both of Fed. Rep. of Germany

[73] Assignee: Union Rheinische Braunkohlen Kraftstoff AG, Wesseling, Fed. Rep. of Germany

[21] Appl. No.: 858,014

[22] Filed: Apr. 30, 1986

Related U.S. Application Data

[63] Continuation of Ser. No. 625,082, Jun. 27, 1984, which is a continuation-in-part of Ser. No. 584,479, Feb. 28, 1984.

[30] Foreign Application Priority Data

Oct. 3, 1983 [DE] Fed. Rep. of Germany ..... 3308433

[51] Int. Cl.[4] ..... C10L 1/02

[52] U.S. Cl. ..... 44/53; 44/56

[58] Field of Search ..... 44/53, 56, 62; 585/14; 148/196 FM, 197 FM, 198 FM, 199 FM

[56] References Cited

U.S. PATENT DOCUMENTS

| | | | |
|---|---|---|---|
| 2,365,009 | 12/1944 | Robertson | 44/53 |
| 2,404,094 | 7/1946 | Robertson | 44/52 |
| 2,473,439 | 6/1949 | Lightfoot | 44/52 |
| 3,591,355 | 7/1971 | Kessler | 44/53 |
| 4,383,836 | 5/1983 | Wilson et al. | 44/56 |

*Primary Examiner*—William R. Dixon, Jr.
*Assistant Examiner*—Margaret B. Medley
*Attorney, Agent, or Firm*—Connolly and Hutz

[57] ABSTRACT

The instant invention relates to fuels based on methanol and/or ethanol which contain additionally mixtures of $C_4$-hydrocarbons with $C_5/C_6$- and/or $C_5$–$C_7$-hydrocarbons and/or gasoline.

20 Claims, 10 Drawing Sheets

M100 with addition of C5/C6-fraction and C4-fraction

M100 with addition of C5-C7-fraction and C4-fraction

M100 with addition of gasoline and C4-fraction

E100 (Ethanol 95.6 % ig) with addition of C5/C6-fraction and C4-fraction

E100 (Ethanol 95.6 % ig)
with addition of C5-C7-fraction and C4-fraction

E 100 (Ethanol 95.6 % ig) with addition of gasoline and C4-fraction

Concentration of C5/C6 (1:1) in Ethanol (95.6% ig)

M100 ("pure" methanol)
Addition of isopentane

M100 ("Crude" methanol)
Addition of isopentane

MOTOR-FUELS

CROSS REFERENCE TO RELATED APPLICATIONS

This is a continuation of Ser. No. 625,082, filed June 27, 1984, which in turn is a continuation-in-part of Ser. No. 584,479, filed Feb. 28, 1984.

BACKGROUND OF THE INVENTION

1. Field of the Invention

The instant invention relates to fuels based on methanol and/or ethanol which contain additionally mixtures of $C_4$-hydrocarbons with $C_5/C_6$-and/or $C_5$–$C_7$-hydrocarbons and/or gasoline.

2. Description of the Prior Art

Distilled ("pure") methanol has been extensively investigated as an alternate fuel for a number of years (Chemische Technologie, Winnacker-Küchler, Vol. 5, Organische Technologie I, 4. Ed. 1981, p. 517).

Higher alcohols and water as blending-components for methanol and the use of these blends as fuels are known (N. Iwai, The combustion of methanol mixed with water, Second Nato-Symposium; Nov. 4–8, 1974, Düsseldorf).

In U.S. Pat. No. 2,365,009 combinations of alcohols with 1 to 5 C-atoms with saturated and unsaturated hydrocarbons with 3–5 C-atoms as fuels are described.

The same applicant discloses in Continuation in part U.S. Pat. No. 2,404,094, fuels, which either consist of absolutely pure methanol or commercial, refined methanol, which is free of water (column 6, lines 8–11) in combination with aliphatic $C_3$–$C_5$ hydrocarbons. This Patent also claims a methanol fuel, which contains 2–20% of an aliphatic $C_4$- or $C_5$-hydrocarbon. According to column 5, lines 22–27, hydrocarbons in highly purified form are preferred. Furthermore the hydrocarbons used, may be partly unsaturated (column 5, lines 28–34). The examples disclose (table 1) as added hydrocarbons n-pentane, iso-pentane and a $C_4$-cut, which contains up to 20% of butenes. According to claims 5 and 6 a mixture of saturated $C_5$-hydrocarbons can be used for the special case of a fuel for the cold start of aviation engines.

In U.S. Pat. No. 2,365,009 also mixtures of ethanol with aliphatic $C_3$–$C_5$-hydrocarbons are described, whereby the aliphatic hydrocarbons may be either saturated or unsaturated and whereby isopentane (claim 8 and table 1) is preferred. Further disclosures of ethanol/hydrocarbon mixtures are DE-OS 28 06 673 and DE-OS 32 11 775.

It is well known to the artisan that in certain countries, with a high supply of ethanol, for example in Brazil, ethanol is used in pure form as well as in mixtures with gasoline as a fuel (Chemical Engineering Progress, April 1979, page 11).

On the other hand it is also known that the lower alcohols have specific disadvantages with regard to their use as fuel, for example bad cold start behavior, bad driving behavior at low outside temperature, unsatisfactory mixing in particular with hydrocarbons at low temperatures and the broad explosibility limits.

The cause of the cold-start problems, in particular at low temperatures, is to be sought in the low ignitibility of methanol and ethanol.

A measure for the ignitibility is the vapor pressure of a motor-fuel, which is determined by the so-called Reid-Test at 37,7° C. Methanol for example has a Reid vapor pressure (RVP) of 350 mbar, whereas gasoline has a Reid vapor pressure of 700 mbar.

At an outside temperature below 15° C. the vapor pressures of methanol and ethanol are too low for the formation of ignitible gasphase mixtures.

The explosibility limits for pure (distilled) methanol in air are 6,75 to 36,7 percent by volume resulting in an explosive mixture of fuel and air in the gasphase in the fuel tank between +15° and +25° C. Addition of 6 to 9 percent by weight of isopentane reduces the upper explosibility limits to −7° C. at summer temperature and −20° C. at winter temperature. As a result the safety problems are essentially avoided. In the state of the art isopentane has been considered therefore and because of its excellent solubility in methanol as well as in ethanol in particular at low temperatures as the preferred additive (isopentane is 2-methylbutane).

The most favorable adjustment of the vapor pressure of neat methanol has turned out to be 700 mbar for summer- and 900 mbar for winter-fuel (which are the upper vapor pressure values of the German fuel DIN-Norm 51600).

In consideration of the problems described above and in consideration of the state of the art and as a consequence of continued investigations, isopentane (2-methylbutane) has been hitherto selected as the optimum hydrocarbon additive.

The fuel consisting of distilled (refined) methanol and isopentane, which is known as M 100 fuel has been tested in extensive field tests for several years, in particular in municipal car fleets in the Federal Republic of Germany (s. H. Müller, 27th DGMK-Conference, 6th to 8th of October, 1982).

Although methanol, which contains isopentene, meets to a certain extend the expectations with regard to a reliable motor-fuel, the tests have unexpectedly shown that there still remain substantial disadvantages.

In particular during operation at summer temperatures the vapor pressure by using methanol/isopentane mixtures is to high even after reduction of the isopentane-content to 5-6 weight percent, accompanied by undesirable degassing of isopentane. Whereas at winter temperatures despite an isopentane content of up to 9 percent by weight a decrease of the vapor pressure is observed which leads to bad cold start behavior at temperatures below −10° C.

Object of the present invention therefore was to make fuels available, based on methanol and ethanol, resulting in an improved driving behavior in particular at relatively high and relatively low outside temperatures, as required in practical operation of a motor-vehicle and which would simultaneously permit safe operation, avoiding the formation of an explosive mixture inside of the fuel tank.

SUMMARY OF THE INVENTION

According to the present invention a motor-fuel based on methanol is provided, which may optionally contain up to 15 percent by weight of water characterized in that it contains additionally a mixture of $C_4$-hydrocarbons and a mixture of $C_5/C_6$- or $C_5$–$C_7$-hydrocarbons or gasoline, whereby the total amount of $C_4$-hydrocarbons and $C_5/C_6$- or $C_5$–$C_7$-hydrocarbons or gasoline in the motor fuel amounts to 0,1 to either 15%, 18% or 25% by weight and whereby the ratio of $C_4$: $C_5/C_6$- or $C_5$–$C_7$ hydrocarbons or gasoline is 1:500 to 3:1 parts by weight and furthermore a motor-fuel based on ethanol is provided, which may optionally contain up to 25 percent by weight of water, characterized in that it contains additionally a mixture of $C_5/C_6$- or $C_5$–$C_7$-hydrocarbons or gasoline, whereby the total amount of $C_4$-hydrocarbons and $C_5/C_6$- or $C_5$–$C_7$-hydrocarbons or gasoline in the motor fuel amounts to 0,1 to either 15%, 18% or 25% by weight and whereby the ratio of $C_4$:$C_5C_6$- or $C_5$–$C_7$-hydrocarbons or gasoline is 1 : 500 to 3 : 1 parts by weight and furthermore motor-fuels consisting of mixtures of at least two of the above fuels and mixtures of at least one of the above fuels and a fuel based on methanol and/or ethanol containing a mixture of $C_4$-hydrocarbons and $C_5$-hydrocarbons whereby the total amount of $C_4$- and $C_5$-hydrocarbons in the fuel amounts to 0,1 to 15 weight-% and the ratio of $C_4$:$C_5$ is 1:500 parts by weight to 3:1 parts by weight.

DESCRIPTION OF SPECIFIC EMBODIMENTS

The present invention leads to the surprising result that mixtures of $C_4$-hydrocarbons and $C_5/C_6$- and/or $C_5$–$C_7$-hydrocarbons and/or gasoline with pure (distilled or refined) methanol as well as with "crude" (non-distilled) methanol and with ethanol resp. technical ethanol which contain water or mixtures thereof meet the above named requirements in superior, hitherto not attainable manner. In particular it was non-obvious for the artisan that the combination of the desired properties could be obtained including safe explosion limits, sufficiently little degassing at high outside temperatures despite the addition of a relatively high water content which also means at a climate of very high humidity, no phase-separation of the fuel mixture, excellent cold-start behavior and driving behavior at low outside temperature as well as high outside temperature, which is a basic necessity for the practical use of alternative fuels.

It was a particularly surprising result that technical streams of $C_4$-, $C_5$-, $C_6$- and $C_7$-hydrocarbons which are formed for example in refineries and production units for bulk chemicals like ethylene and benzene/toluene (BT), as well as gasoline are excellently suited despite of differing compositions with regard to individual hydrocarbons. The total amount of $C_4$-, $C_5/C_6$-, and $C_5$–$C_7$-hydrocarbons and gasoline can be 0,1 to 15% ($C_4$, $C_5/C_6$), 0,1 to 18% ($C_4$, $C_5$–$C_7$) and 0,1 to 25% (gasoline) by weight, whereby a total amount of 1–12%, 1–16% and 1–20% is preferred. The ratio of $C_4$- to $C_5/C_6$- to $C_5$–$C_7$-hydrocarbons and to gasoline is 1:500 to 3:1, a ratio of 1:1 to 1:20 being preferred.

Small amounts of non-$C_4$-, non-$C_5$-, $C_6$- and $C_7$-hydrocarbons as inevitably present in technical streams can be present in the inventive fuels, independent of wether theses hydrocarbons are aromatic or non-aromatic. Suitable streams are exemplarily represented in the following analyses:

| | | |
|---|---|---|
| | $C_4$-stream | |
| $C_3$ | 2,4% | by weight |
| $C_4$ unsaturated | 0,5 | by weight |
| isobutane | 34,9 | by weight |
| n-butane | 62,0 | by weight |
| $>C_4$ | 0,2 | by weight |
| | $C_5$-stream | |
| $C_4$ | 0,56% | by weight |
| $C_5$ unsaturated | 1,38 | by weight |
| isopentane | 28,15 | by weight |
| n-pentane | 30,31 | by weight |
| cyclopentane | 27,3 | by weight |
| $>C_5$ | 12,3 | by weight |
| | $C_6$-stream | |
| n-butane | 1,0 | by weight |
| cyclopentane | 1,6 | by weight |
| 2-methylpentane | 2,5 | by weight |
| 3-methylpentane | 3,0 | by weight |
| 2-ethylbutene | 11,2 | by weight |
| methylcyclopentane | 32,0 | by weight |
| benzene | 29,2 | by weight |
| cyclohexane | 7,4 | by weight |
| 2-methylhexane | 1,5 | by weight |
| 3-methylhexane | 1,1 | by weight |
| others | 9,5 | by weight |
| | $C_7$-stream | |
| n-heptane | 2,2 | by weight |
| methylcyclohexane | 15,3 | by weight |
| 1-methylhexene | 1,2 | by weight |
| ethylcyclohexane | 10,7 | by weight |
| ethylcyclopentane | 18,2 | by weight |
| 1,3-dimethylpentene | 8,3 | by weight |
| toluene | 30,1 | by weight |
| 2,4-dimethylpentane | 4,5 | by weight |
| others | 9,6 | by weight |

Gasoline can be regular as well as premium quality.

It is possible in the case of the fuels of the present invention in analogy to other known alternative fuels, to add certain amounts of other conventional components for example $C_3$-, $C_4$- and higher alcohols, ethers, like methyl-tert.-butylether and other readily available ethers, furthermore, ketones, like acetone, as well as aromatic components like benzene, toluene and xylene.

According to the state of the art fuels based on methanol have been prepared with distilled refined methanol resp. so-called "pure" methanol. It is known to the artisan, that high requirements with regard to purity of distilled (pure) methanol exist which are met by a corresponding high operational effort, in particular in the distillation step.

With regard to certain technical problems, which are encountered with methanol fuel for example corrosive and dissolving effects of methanol on parts of the motor-vehicle, like tubing, tank lining, certain motor-parts, and motor construction material and furthermore high requirements with regard to complete combustion as a consequence of increasing environmental protection provisions, accompanied by the requirement of avoiding deposits in particular in motor and carburator, the artisan has hitherto assumed that non-distilled methanol as produced in low-, middle- or high pressure methanol production units is unsuited for the use as motor fuel.

Non-distilled, so-called crude methanol, is known to contain besides water a number of contaminations like formaldehyde, methylformiate, formic acid, dimethylsulfide, formaldehyde, dimethylacetale, iron pentacarbonyle, various carboxylic acids and esters.

It has been a non-obvious result of the investigations of applicant, that in contrast to the prejudice of the artisan non-distilled methanol is excellently suited as a fuel in the inventive fuel mixture, in particular with regard to the effects on those parts of the motor-vehicle which are in contact with the fuel as well as with regard to emissions. Surprisingly it has been found that the emissions of CO, $NO_x$ and hydrocarbons are even lower compared to distilled (pure) methanol. This is shown in the following table:

TABLE 1

| | | distilled (pure) methanol | | | non-distilled (crude) methanol | | |
|---|---|---|---|---|---|---|---|
| | gasoline | $C_4/C_5/C_6$ 7% by weight | $C_4/C_5$–$C_7$ 7,7% by weight | $C_4$/gasoline 12,3% by weight | $C_4/C_5/C_6$ 7% by weight | $C_4/C_5$–$C_7$ 7,7% by weight | $C_4$/gasoline 12,3% by weight |
| CO (g/test) | 86,5 | 40,4 | 40,5 | 53,2 | 37,1 | 37,5 | 48,1 |
| hydrocarbons (g/test) | 8,6 | 3,6 | 3,6 | 4,0 | 2,9 | 2,8 | 3,7 |
| $NO_x$ (g/test) | 12,5 | 3,2 | 3,3 | 3,9 | 2,4 | 2,4 | 2,9 |

According to the invention also topped crude methanol can be used, which contains less of low vapor pressure contaminations.

The excellent properties of the inventive fuels are further illustrated with the aid of FIGS. 1 to 10:

Figure 1:
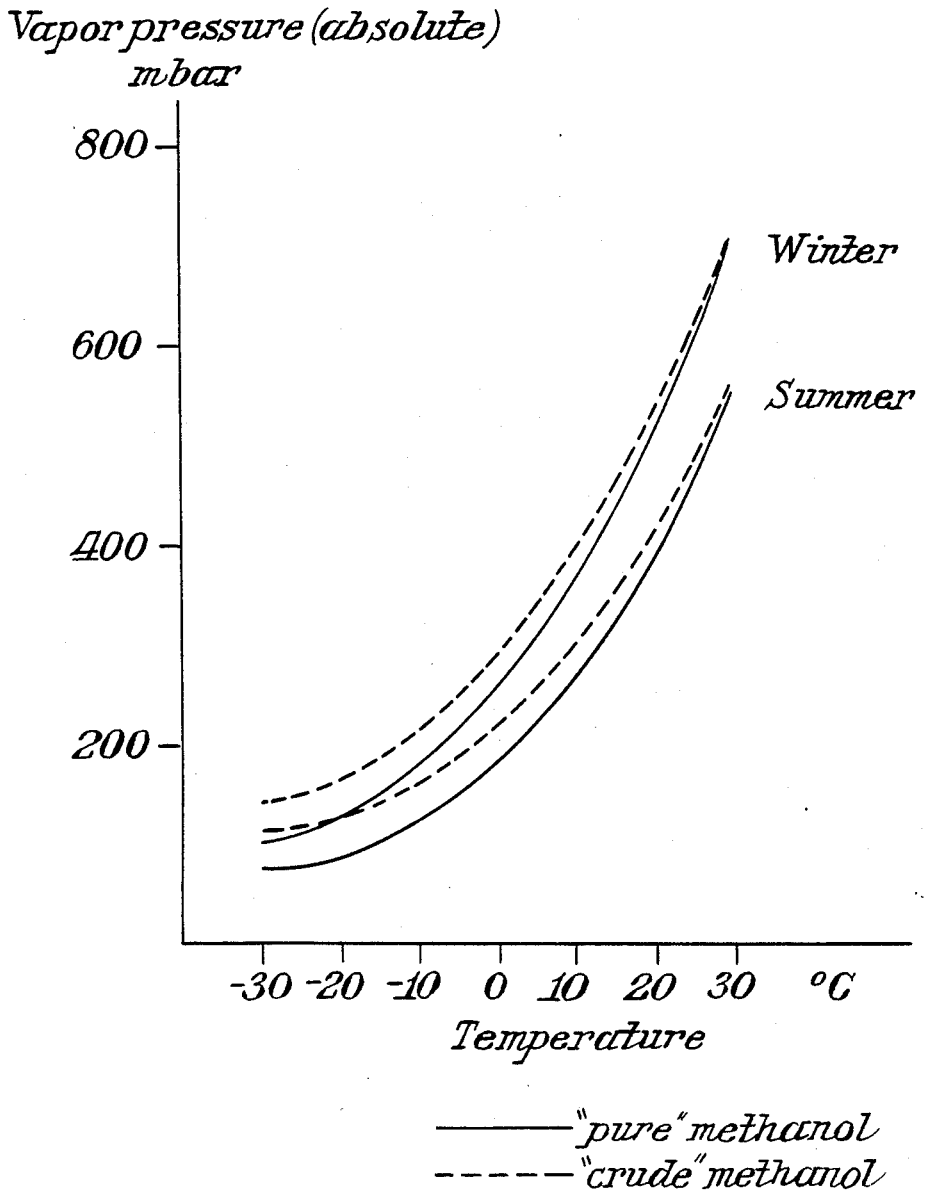
FIG. 1 represents the dependence of the vapor pressure (absolute) of an inventive fuel which contains $C_4$-/$C_5$-/$C_6$-hydrocarbons on the temperature for summer and winter grade with "pure" and "crude" methanol (table 2).
Figure 4:
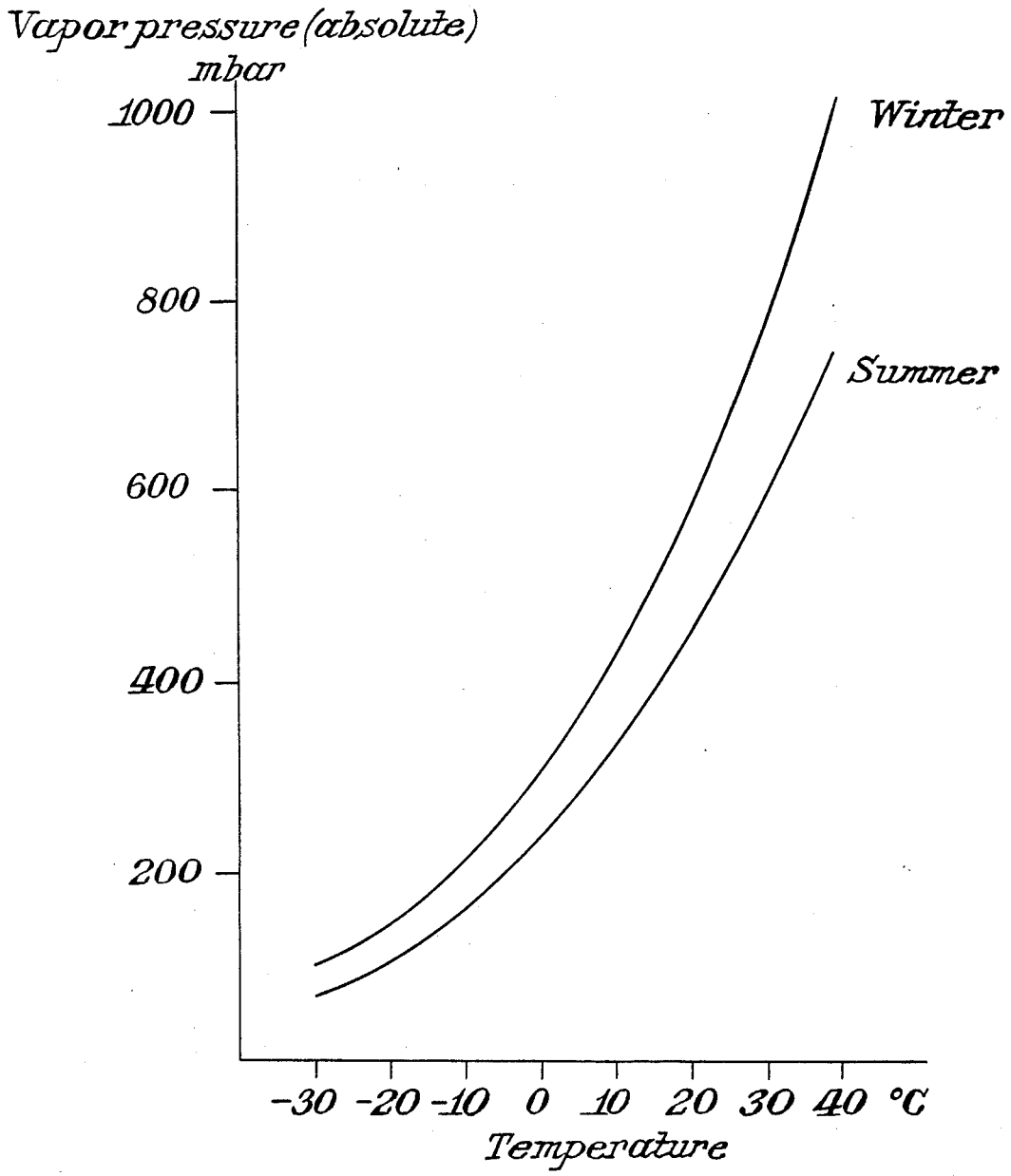

FIG. 4 corresponds to FIG. 1 with ethanol (95,6% by weight ethanol and 4,4 % by weight of $H_2O$) instead of methanol.

Figure 2:
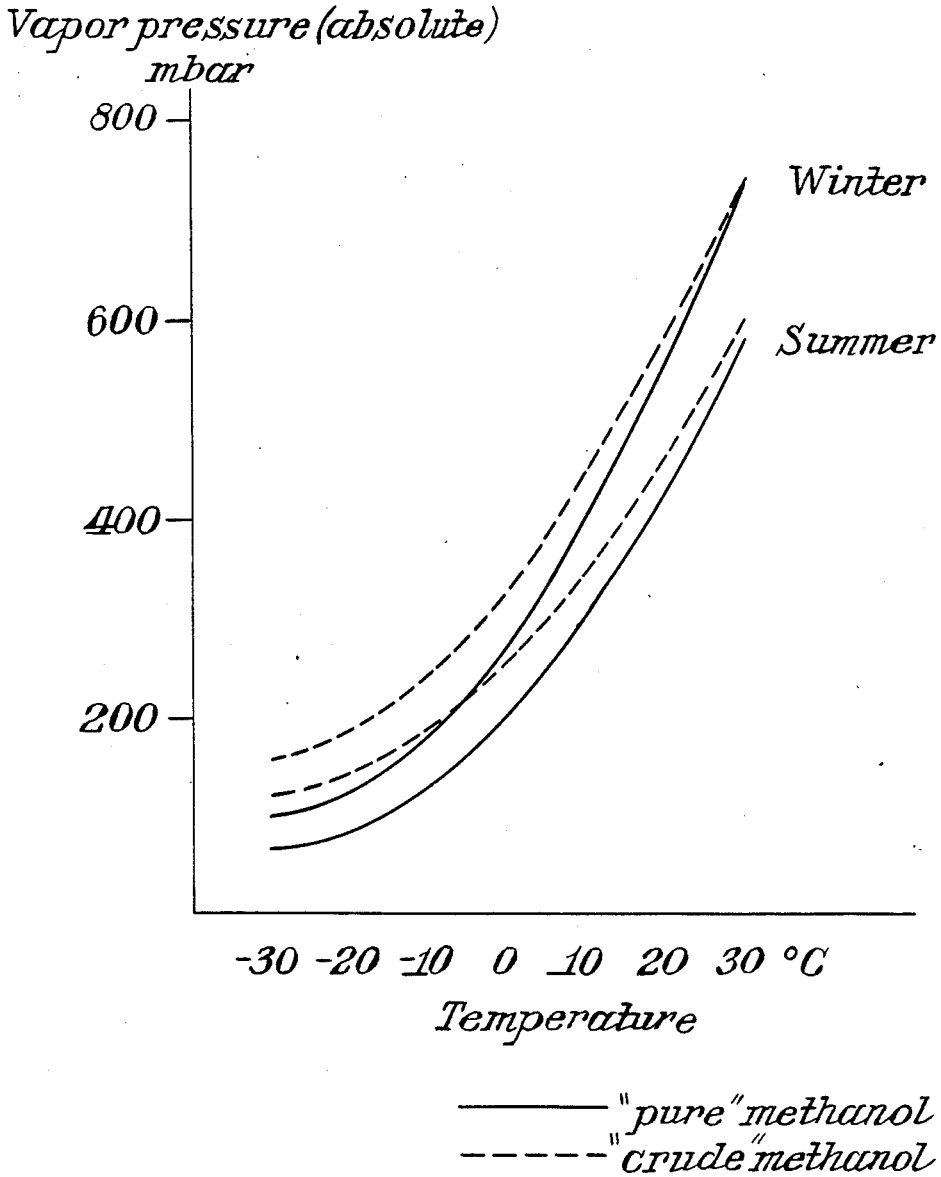
FIG. 2 represents the same dependence as FIG. 1 with $C_4/C_5$–$C_7$-hydrocarbons added.
Figure 5:
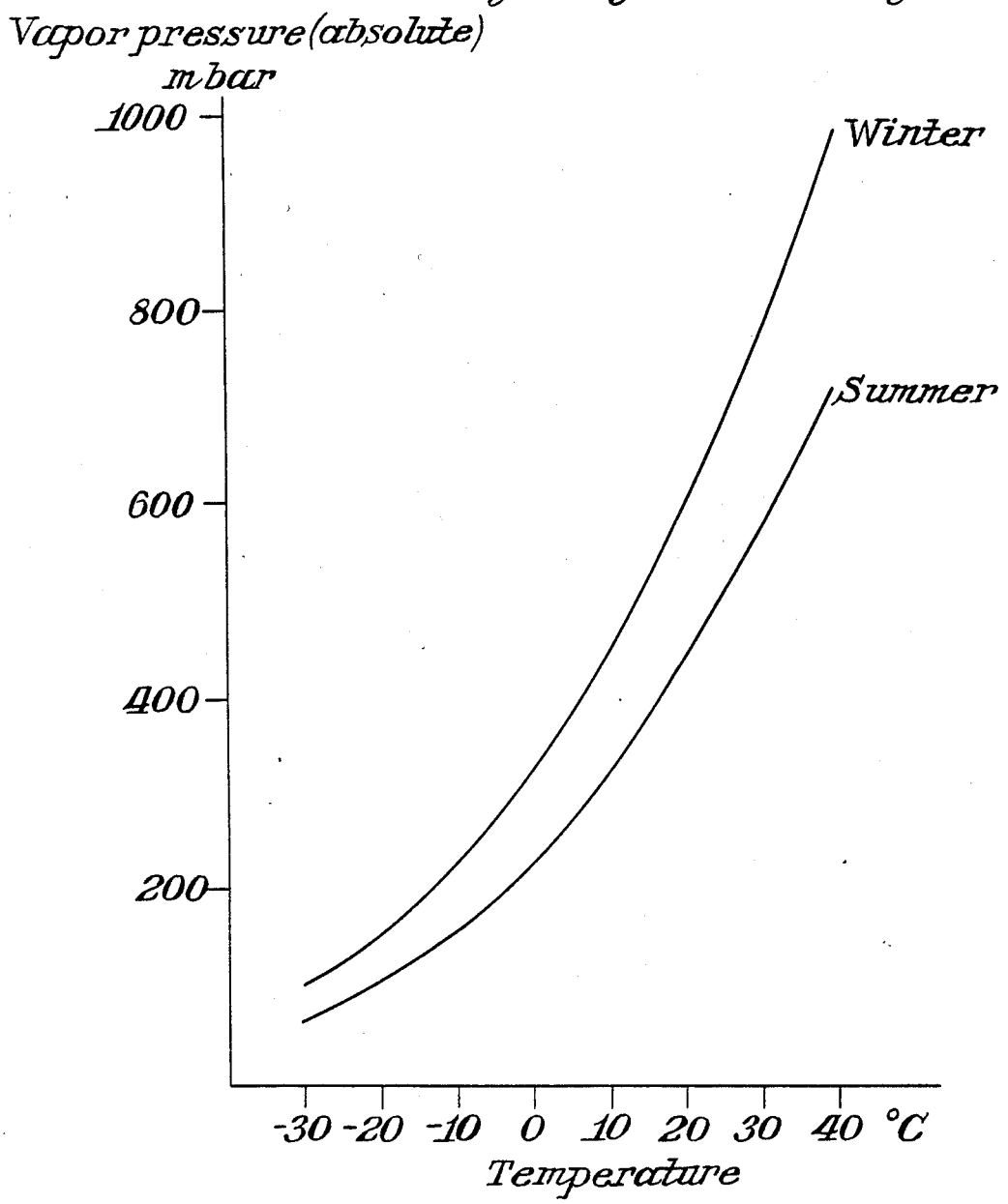

FIG. 5 corresponds to FIG. 2 with ethanol (95,6% by weight ethanol and 4,4 % by weight of $H_2O$) instead of methanol.

Figure 3:
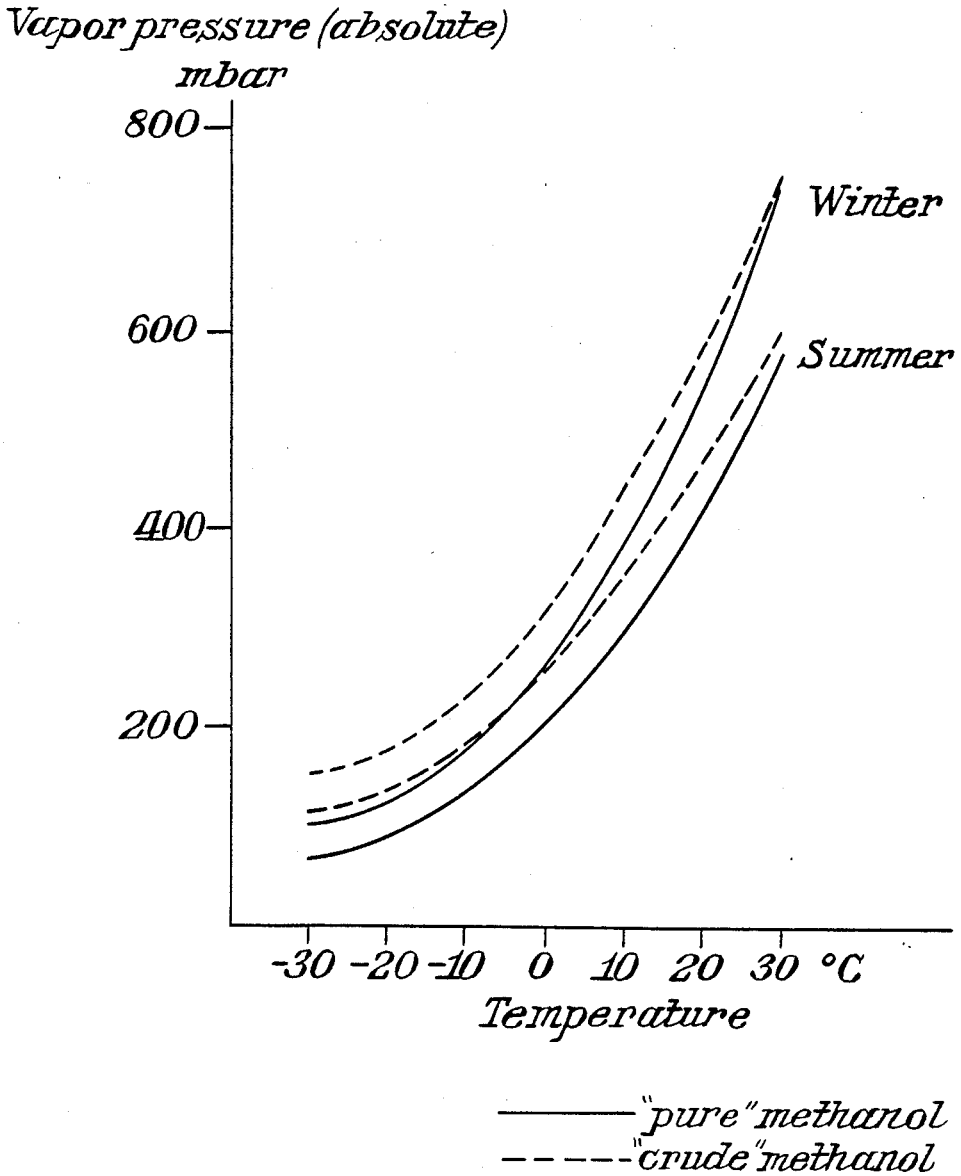
FIG. 3 represents the same dependence with $C_4$-hydrocarbons and gasoline added.
Figure 6:
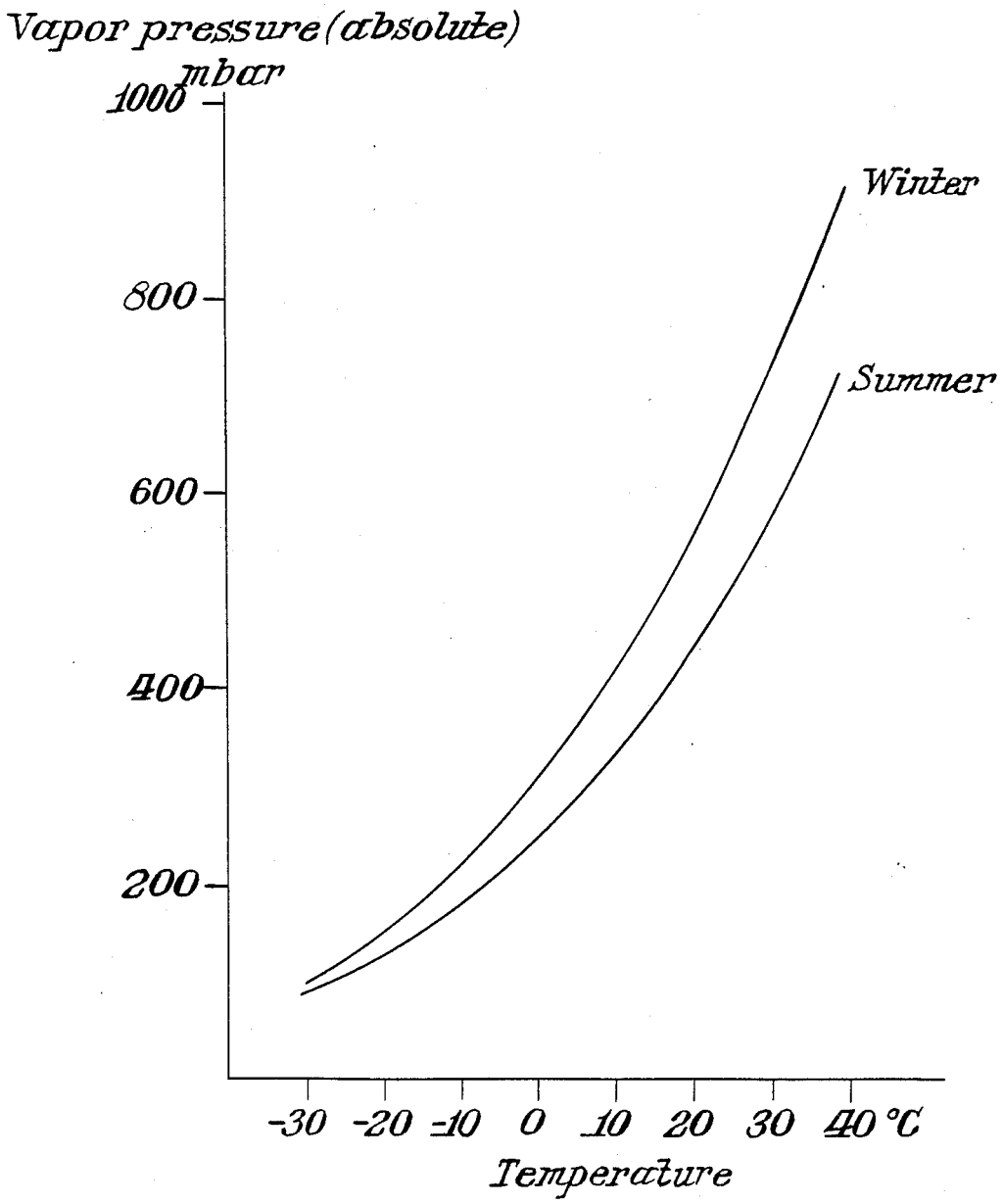

FIG. 6 corresponds to FIG. 3 with ethanol (95,6% by weight ethanol and 4,4 % by weight of $H_2O$) instead of methanol.

Figure 7:
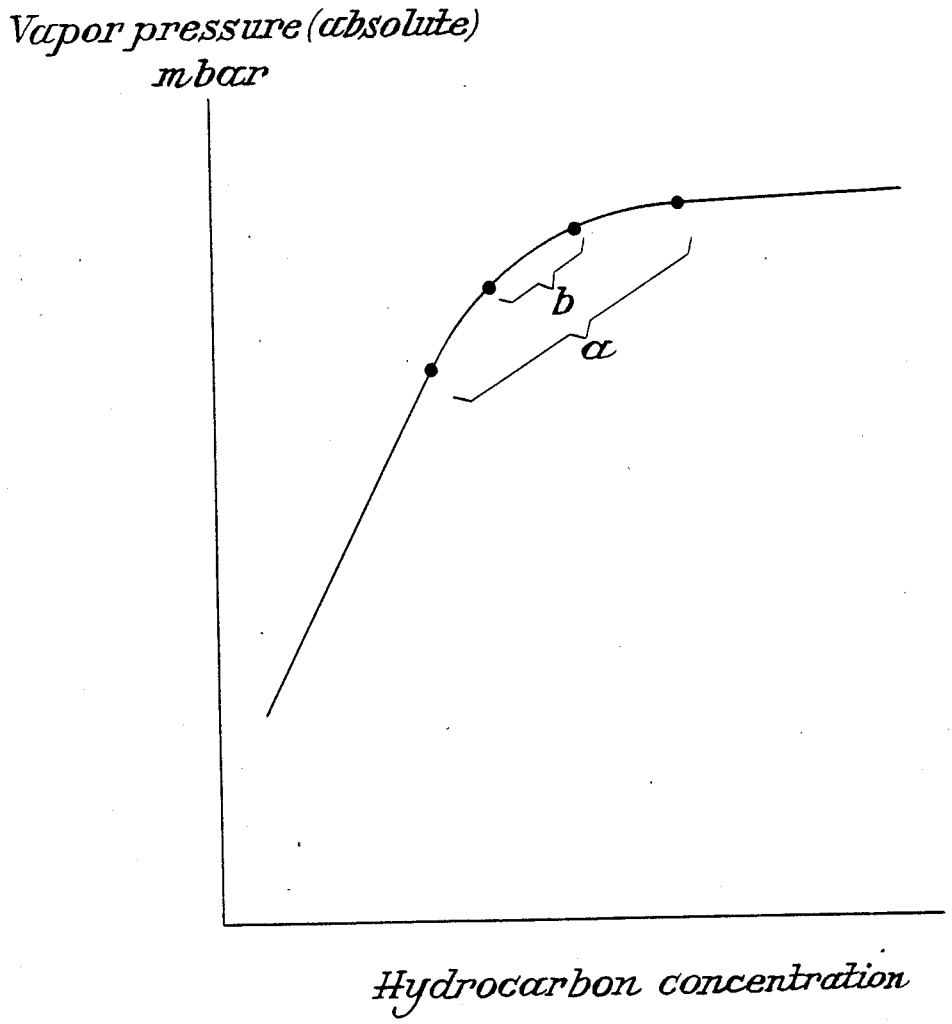

FIG. 7 represents in a general manner the preferred range of added hydrocarbon quantities.

Figure 8:
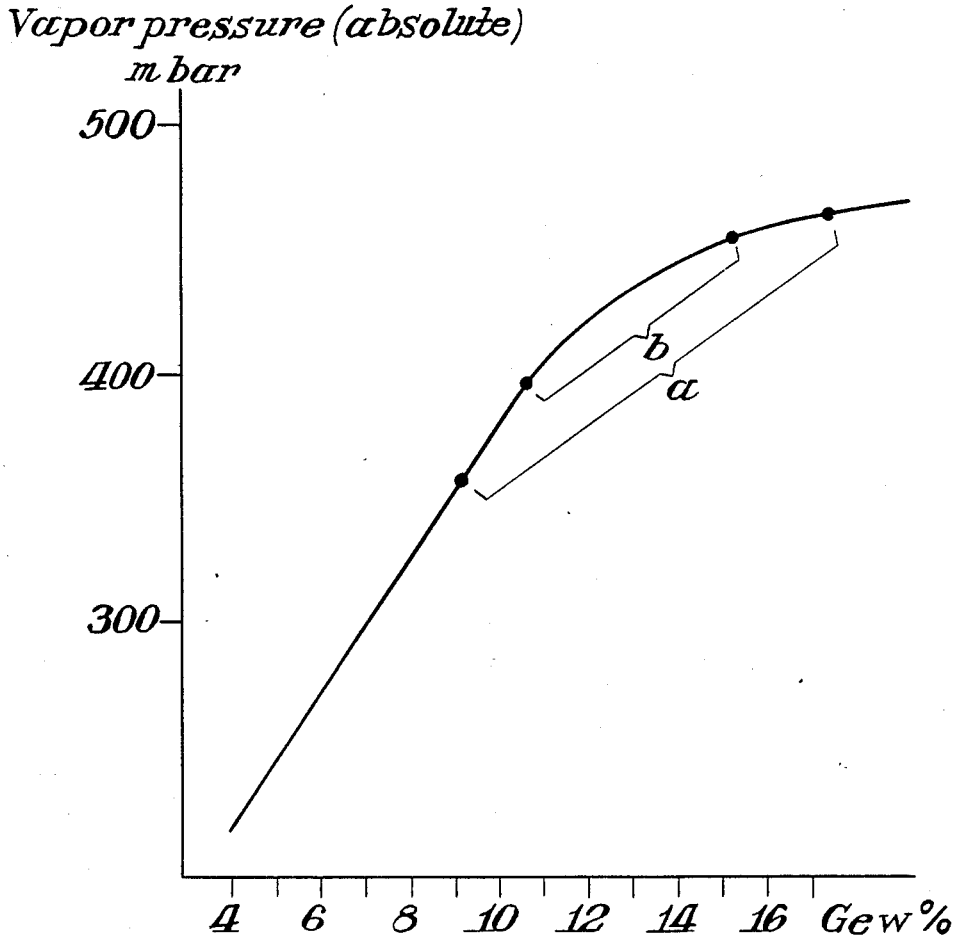

FIG. 8 represents the preferred range of added hydrocarbons in the particular case of ethanol (95,6 %) and $C_5/C_6$-hydrocarbons.

Figure 9:
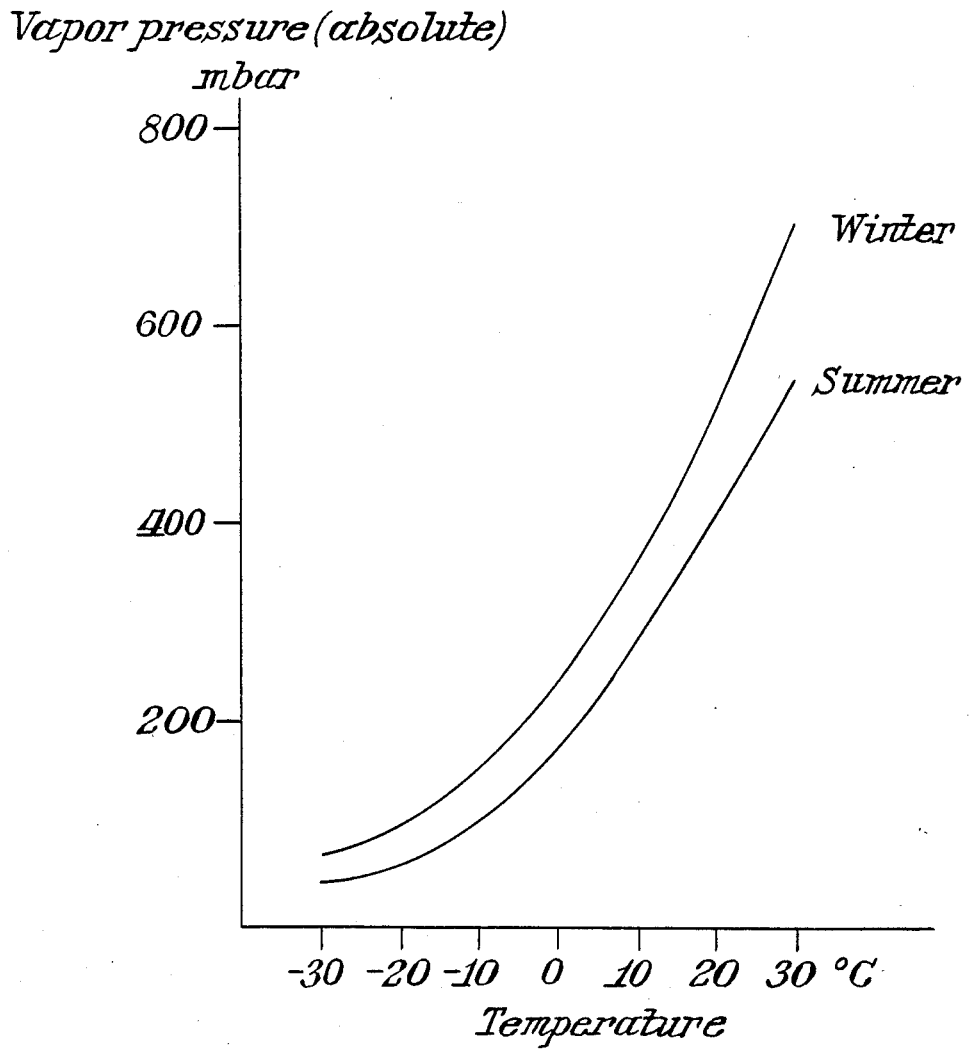
Figure 10:
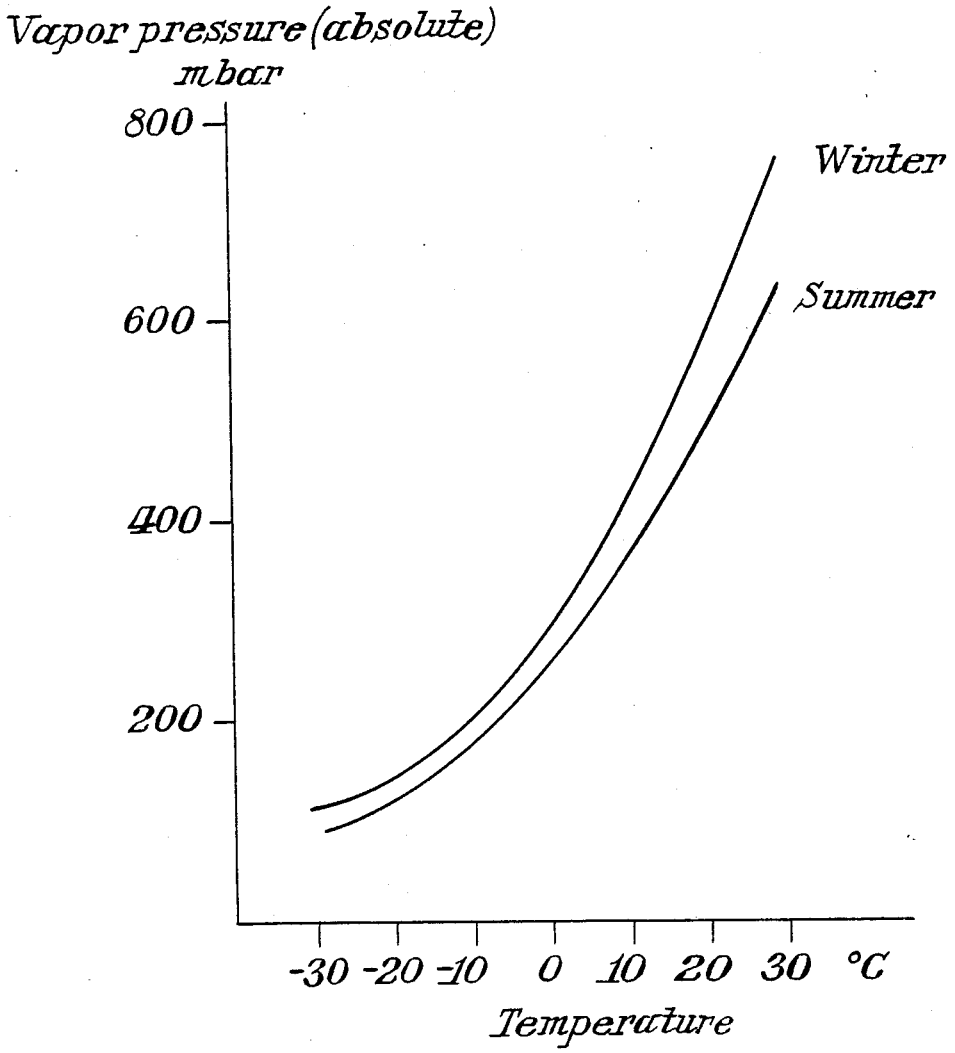

FIG. 9 and 10 represent vapor pressure curves for comparison purposes with isopentane-additions on a "pure" and "crude"-methanol basis in accordance to the state of art.

In FIG. 1 the vapor pressure is expressed in mbar. The temperature range investigated is between −30° C. to +30° C. for winter and summer fuels.

Table 2 represents the compositions in weight percent for $C_4/C_5/C_6$ addition.

TABLE 2

| | "pure" methanol | $C_4$ | $C_5$ | $C_6$ | "crude" methanol | $C_4$ | $C_5$ | $C_6$ |
|---|---|---|---|---|---|---|---|---|
| summer | 92,1 | 0,9 | 3,5 | 3,5 | 92,7 | 0,3 | 3,5 | 3,5 |
| winter | 90,9 | 2,1 | 3,5 | 3,5 | 91,9 | 1,1 | 3,5 | 3,5 |

The Reid vapor pressures are as in the comparative example of isopentane-addition 700 mbar for summar and 900 mbar for winter grade. The quantities of $C_5$- and $C_6$-hydrocarbons are the same for all mixtures.

In the Reid vapor pressure of a mixture of methanol and hydrocarbons is plotted against increasing quantities of hydrocarbons in the mixture at constant temperature (Reid-temperature) the vapor pressure at the beginning rises almost linearly with increasing quantities of added hydrocarbons. At a particular quantity of hydrocarbons one arrives at a range of a pronounced decrease of the vapor pressure increase and with further addition of hydrocarbons the curve continues almost horizontally. The general behavior is presented in FIG. 7.

A specific diagram is represented in FIG. 8 representing the vapor pressure dependence of an ethanol/$C_5$-/$C_6$-hydrocarbon mixture.

If the total quantity of for example $C_5$- and $C_6$-hydrocarbons is kept constant, however the ratio of $C_5$- to $C_6$-hydrocarbons is varied, an analogous family of curves is obtained.

It has proven to be advantageous with regard to the stability of the individual fuels that is with regard to a minium of degasing on the one hand combined with the desired vapor pressures of the inventive fuels during winter and summer operation on the other hand to choose such as added quantity of $C_5/C_6$-, respectively $C_5$–$C_7$-hydrocarbons, respectively gasoline, that one is positioned in the range of transition from the rising part of the curve to the almost horizontal part of the curve represented in FIG. 7.

The preferred resp. particularly preferred ranges are indicated in FIG. 7*a* and *b*.

FIG. 2 represents the vapor pressure of fuels consisting of "pure" resp. "crude" methanol was added $C_4$-/$C_5$–$C_7$-hydrocarbons in mbar plotted against the temperature range of −30° C. to +30° C. for winter and summer operation. Table 3 contains the compositions in weight-% of these mixtures.

TABLE 3

| | pure methanol | $C_4$ | $C_5$ | $C_6$ | $C_7$ | crude methanol | $C_4$ | $C_5$ | $C_6$ | $C_7$ |
|---|---|---|---|---|---|---|---|---|---|---|
| summer | 92,3 | 0,7 | 4,5 | 1,5 | 1,0 | 92,9 | 0,1 | 4,5 | 1,5 | 1,0 |
| winter | 91,2 | 1,8 | 4,5 | 1,5 | 1,0 | 92,1 | 0,9 | 4,5 | 1,5 | 1,0 |

Again the Reid vapor pressures are 700 mbar for summer operation and 900 mbar for winter operation. The quantities of $C_5$- to $C_7$-hydrocarbons have been kept constant for the different mixtures.

In FIG. 4 the vapor pressure of fuels based on "pure" resp. "crude" methanol with added gasoline in mbar is plotted against the temperature range of −30° C. to +30° C. for winter and summer operation.

Table 4 contains the compositions of the fuels in weight-%.

TABLE 4

| | pure methanol | $C_4$ | gasoline | crude methanol | $C_4$ | gasoline |
|---|---|---|---|---|---|---|
| summer | 87,7 | 1,1 | 11,2 | 90,2 | 0,9 | 8,9 |
| winter | 82,8 | 1,8 | 15,4 | 86,6 | 1,6 | 11,8 |

The Reid vapor pressures are 700 mbar for summer operation and 900 mbar for winter operation. Since gasoline compositions are different for winter and summer operation, the added quantities have not been kept constant, but common summer and winter gasoline fuels have been added in variing quantities, in the range of the preferred quantities represented in FIG. 7.

FIGS. 1 to 3 exhibit surprising results for the artisan. It is known that with respect to the addition of isopentane, which represents the state of the art, lower vapor pressures of methanol-resp. ethanol fuels for summer operation and higher vapor pressures for winter operation are necessary for the practical use of such fuels in the public domain. The vapor pressures of the inventive fuels represented in the diagrams of FIGS. 1 to 3 are summarized in table 5. The data show that non-obvious to the artisan the inventive fuels exhibit an excellent vapor pressure behavior.

TABLE 5

(based on Reid vapor pressure, 700 mbar for summer and 900 mbar for winter operation determind at 37,7° C.)

| | pure methanol | crude methanol |
|---|---|---|
| Isopentane, 30° C. summer | 550 mbar | 620 mbar |
| Isopentane, −30° C., winter | 70 mbar | 110 mbar |
| $C_4/C_5/C_6$, 30° C. summer | 555 mbar | 565 mbar |
| $C_4/C_5/C_6$, −30° C. winter | 100 mbar | 140 mbar |
| $C_4/C_5$–$C_7$, 30° C. summer | 580 mbar | 595 mbar |
| $C_4/C_5$–$C_7$, −30° C. winter | 100 mbar | 160 mbar |
| $C_4$/OK, 30° C. summer | 570 mbar | 590 mbar |
| $C_4$/OK, −30° C. winter | 100 mbar | 150 mbar |

Considering pure methanol one notices that the inventive additions of $C_4$-hydrocarbons in combination with the higher hydrocarbons, in the particular case of isopentane lead to a vapor pressure of 550 bar for summer fuel and 70 mbar for winter fuel.

Only a slight increase is observed with added $C_4/C_5/C_6$- and $C_4/C_5$–$C_7$ resp. $C_4$/gasoline for summer fuel. If however winter fuels are considered one observes that the inventive additions of $C_4C_5/C_6$- and $C_4/C_5$–$C_7$-hydrocarbons resp. of $C_4$/gasoline lead to a surprising and for practical purposes very important increase of the vapor pressures compared to isopentane-addition namely of an increase of 30 mbar for winter quality based on pure methanol and of 30, 50 and 40 mbar for winter quality based on crude methanol.

These certainly non-obvious results are a decisive contribution with respect to the introduction of neat methanol and ethanol fuels to the public domain where reliable properties of fuels are necessary even under extreme climatic conditions.

The explosibility limits are represented in table 6. One observes that the inventive fuels in comparison to the addition of isopentane exhibit broader ranges than the state of the art.

TABLE 6

(based on Reid vapor pressure)

| Upper explosion-temperature | pure methanol °C. | isopentane °C. | $C_4/C_5/C_6$ °C. | $C_4/C_5$–$C_7$ °C. | $C_4$/gasoline °C. |
|---|---|---|---|---|---|
| summer | +25 | −7 | <−20 | <−20 | <−20 |
| winter | +15 | −20 | <−25 | <−25 | <−25 |

Comparison of the vapor pressures of FIGS. 4, 5 and 6 at 30° C. (summer curves) and −30° C. (winter curves) with the corresponding isopentane/"pure methanol" vapor pressures shows that under Reid conditions also with ethanol (E 100) and additions of $C_4/C_5/C_6$, $C_4/C_5$–$C_4$/gasoline an excellent vapor pressure behavior in particular for winter operation is observed.

The vapor pressures are summarized in table 7.

TABLE 7

(Reid vapor pressure basis)
700 mbar at summer and 900 mbar at winter operation, determined at 37,7° C.

| | Ethanol 95,6% |
|---|---|
| $C_4/C_5/C_6$ summer 30° C. | 580 mbar |
| $C_4/C_5/C_6$ winter −30° C. | 95 mbar |
| $C_4/C_5$–$C_7$ summer 30° C. | 552 mbar |
| $C_4/C_5$–$C_7$ winter −30° C. | 105 mbar |
| $C_4$/OK summer 30° C. | 560 mbar |
| $C_4$/OK winter −30° C. | 103 mbar |

Table 8 summarizes the compositions of the inventive fuels based on ethanol.

TABLE 8

| | Ethanol 95,6% | $C_4$ | $C_5$ | $C_6$ | $C_7$ | OK |
|---|---|---|---|---|---|---|
| Summer | 89,0 | 2,0 | 4,5 | 4,5 | | |
| Winter | 87,5 | 3,5 | 4,5 | 4,5 | | |
| Summer | 89,3 | 1,7 | 5,5 | 2,5 | 1,0 | |
| Winter | 87,5 | 3,5 | 5,5 | 2,5 | 1,0 | |
| Summer | 81,6 | 2,4 | | | | 16,0 |
| Winter | 76,5 | 3,5 | | | | 20,0 |

Excellent results are obtained with the inventive fuels with regard to the explosibility limits, as shown in table 9.

TABLE 9

| Upper explosion temperature | $C_4/C_5/C_6$ | $C_4/C_5$–$C_7$ | $C_4$/OK |
|---|---|---|---|
| Summer | <−20° C. | <−20° C. | <−20° C. |
| Winter | <−25° C. | <−25° C. | <−25° C. |

FIG. 8 shows examplarily the addition of $C_5/C_6$ to ethanol on the basis of the general curve of FIG. 7, and how the preferred resp. particularily preferred ranges a and b are selected.

The ratio of $C_5$:$C_6$ is 1:1 in this example. If the concentration of $C_5/C_6$, resp. $C_5$–$C_7$, resp. OK has been determind according to curve 7 resp. 8, $C_4$ is added in such a quantity in order to obtain the desired Reid vapor pressure.

It is known to the artisan that the Reid vapor pressures of 700 mbar (summer) and 900 mbar (winter) are preferred as a basis for comparison for the inventive fuels, that however other basic vapor pressures could also be used for comparative purposes within the scope of the instant application and the disclosed fuels.

The use of additives in the case of the inventive fuels can be as usual for alcohol-fuels. Suitable corrosion inhibitors are for example triazol-, imidazol- or benzoate-derivatives. Ingnition control additives may be tricresyl phosphate as well as other common formulations.

Optionally, emulsifying agents can be used like glykols or glykolmono- or diethers.

Further additive additions are within the scope of the instant application. It is to be emphasized that the synergistic effects of the inventively combined components resulting in the inventive fuels based on "pure" (distilled), and "crude" (non-distilled) methanol and ethanol, lead to fuels with hitherto non-attainable properties. These fuels which can be produced not only from mineral oil but also from coal and bioethanol, are of greatest economic importance.

It is a non-obvious and surprising result of the instant invention that the inventive fuels combine the desired properties in such an excellent way.

We claim:

1. Fuels based on methanol containing up to 15 weight-% of water, characterized in that the methanol contains a mixture of $C_4$-hydrocarbons and a mixture of $C_5/C_6$-hydrocarbons whereby (a) the total amount of $C_4$- and $C_5/C_6$-hydrocarbons in the fuel amounts to 0,1 to 15 weight-% and (b) the ratio of $C_4$:$C_5/C_6$ is 1:500 parts by weight to 3:1 parts by weight.

2. Fuels based on methanol containing up to 15 weight-% of water, characterized in that the methanol contains a mixture of $C_4$-hydrocarbons and a mixture of $C_5$–$C_7$-hydrocarbons whereby (a) the total amount of $C_4$- and $C_5$–$C_7$-hydrocarbons in the fuel amounts to 0,1 to 18 weight-% and (b) the ratio of $C_4$:$C_5$–$C_7$ is 1:500 parts by weight to 3:1 parts by weight.

3. Fuels based on methanol containing up to 15 weight-% of water, characterized in that the methanol contains a mixture of $C_4$-hydrocarbons and gasoline whereby (a) the total amount of $C_4$-hydrocarbons and gasoline in the fuel amounts to 0,1–25 weight-% and (b) the ratio of $C_4$:gasoline is 1:500 parts by weight to 3:1 parts by weight.

4. Fuels according to claim 1 wherein the methanol used is non-distilled technical methanol.

5. Fuels based on ethanol containing up to 25 weight-% of water, characterized in that the ethanol contains a mixture of $C_4$-hydrocarbons and a mixture of $C_5/C_6$-hydrocarbons whereby (a) the total amount of $C_4$- and $C_5/C_6$-hydrocarbons in the fuel amounts to 0,1 to 15 weight-% and (b) the ratio of $C_4$:$C_5/C_6$ is 1:500 parts by weight to 3:1 parts by weight.

6. Fuels based on ethanol containing up to 25 weight-% of water, characterized in that the ethanol contains a mixture of $C_4$-hydrocarbons and a mixture of $C_5$ - $C_7$-hydrocarbons whereby (a) the total amount of $C_4$- and $C_5$–$C_7$-hydrocarbons in the fuel amounts to 0,1 to 18 weight-% and (b) the ratio of $C_4$:$C_5$–$C_7$ is 1:500 parts by weight to 3:1 parts by weight.

7. Fuels based on ethanol containing up to 25 weight-% of water, characterized in that the ethanol contains a mixture of $C_4$-hydrocarbons and gasoline whereby (a) the total amount of $C_4$-hydrocarbons and gasoline in the fuel amounts to 0,1 to 25 weight-% and (b) the ratio of $C_4$:gasoline is 1:500 parts by weight to 3:1 parts by weight.

8. Fuels according to claim 5 wherein the ethanol used is a water-containing, technical ethanol.

9. Fuels mixture comprising fuels according to claim 5 and a fuel based on methanol which contains up to 15 weight-% of water and which contains a mixture of $C_4$-hydrocarbons and a mixture of $C_5$-hydrocarbons, whereby (a) the total amount of $C_4$- and $C_5$-hydrocarbons in the fuel amounts to 0,1 to 15 weight-% and (b) the ratio of $C_4$:$C_5$-hydrocarbons is 1:500 weight-% to 3:1 weight-%.

10. Fuels based on claim 9, characterized in that the methanol used is an non-distilled technical methanol.

11. Fuels mixture comprising fuels according to claim 1 and a fuel based on ethanol which contains up to 25 weight-% of water and which contains a mixture of $C_4$-hydrocarbons and a mixture of $C_5$-hydrocarbons whereby (a) the total amount of $C_4$- and $C_5$-hydrocarbons in the fuels amounts to 0,1 to 15 weight-% and (b) the ratio of $C_4$:$C_5$-hydrocarbons is 1:500 parts by weight to 3:1 parts by weight.

12. Fuels according to claims 11 characterized in that the ethanol used is a water containing, technical ethanol.

13. Fuels according to claim 2 wherein the methanol used is non-distilled technical methanol.

14. Fuels according to claim 3 wherein the methanol used is non-distilled technical methanol.

15. Fuels according to claim 6 wherein the ethanol used is a water-containing technical ethanol.

16. Fuels according to claim 7 wherein the ethanol used is a water-containing technical ethanol.

17. Fuels mixture comprising fuels according to claim 6 and a fuel based on methanol which contains up to 15 weight-% of water and which contains a mixture of $C_4$-hydrocarbons and a mixture of $C_5$-hydrocarbons, whereby (a) the total amount of $C_4$- and $C_5$-hydrocarbons in the fuel amounts to 0.1 to 15 weight-% and (b) the ratio of $C_4$:$C_5$-hydrocarbons is 1:500 weight-% to 3:1 weight-%.

18. Fuels mixture comprising fuels according to claim 7 and a fuel based on methanol which contains up to 15 weight-% of water and which contains a mixture of $C_4$-hydrocarbons and a mixture of $C_5$-hydrocarbons, whereby (a) the total amount of $C_4$- and $C_5$-hydrocarbons in the fuel amounts to 0.1 to 15 weight-% and (b) the ratio of $C_4$:$C_5$-hydrocarbons is 1:500 weight-% to 3:1 weight-%.

19. Fuels mixture comprising fuels according to claim 2 and a fuel based on ethanol which contains up to 25 weight-% of water and which contains a mixture of $C_4$-hydrocarbons and a mixture of $C_5$-hydrocarbons whereby (a) to total amount of $C_4$- and $C_5$-hydrocarbons in the fuels amounts to 0.1 to 15 weight-% and (b) the ratio of $C_4$:$C_5$-hydrocarbons is 1:500 parts by weight to 3:1 parts by weight.

20. Fuels mixture comprising fuels according to claim 3 and a fuel based on ethanol which contains up to 25 weight-% of water and which contains a mixture of $C_4$-hydrocarbons and a mixture of $C_5$-hydrocarbons whereby (a) the total amount of $C_4$- and $C_5$-hydrocarbons in the fuels amounts to 0.1 to 15 weight-% and (b) the ratio of $C_4$:$C_5$-hydrocarbons is 1:500 parts by weight to 3:1 parts by weight.

* * * * *